United States Patent [19]

Budzyn

[11] 4,185,443

[45] Jan. 29, 1980

[54] BAG SEALING MACHINE

[75] Inventor: Boleslaw L. Budzyn, Passaic, N.J.

[73] Assignee: Weldotron Corporation, Piscataway, N.J.

[21] Appl. No.: 843,871

[22] Filed: Oct. 20, 1977

Related U.S. Application Data

[63] Continuation-in-part of Ser. No. 735,036, Oct. 22, 1976, abandoned.

[51] Int. Cl.[2] ..... B65B 9/08

[52] U.S. Cl. ..... 53/550; 53/555; 53/258

[58] Field of Search ..... 53/182 R, 182 M, 183, 53/258, 550, 553, 555; 156/515

[56] References Cited

U.S. PATENT DOCUMENTS

| | | | |
|---|---|---|---|
| 2,850,855 | 9/1958 | Offutt | 53/258 X |
| 3,128,584 | 4/1964 | Muskat et al. | 53/553 X |
| 3,264,798 | 8/1966 | Hayes et al. | 53/374 |
| 3,390,509 | 7/1968 | Kamp | 53/258 X |
| 3,508,378 | 4/1970 | Fehr et al. | 53/553 |
| 3,581,461 | 6/1971 | McDurmont | 53/182 R |
| 3,583,888 | 6/1971 | Shanklin | 53/182 R |
| 3,628,306 | 12/1971 | Jacobson et al. | 53/553 |
| 3,902,301 | 9/1975 | Harkness et al. | 53/182 R X |
| 4,019,307 | 4/1977 | Ballestrazzi et al. | 53/182 R |

*Primary Examiner*—Travis S. McGehee
*Attorney, Agent, or Firm*—Robert A. Green

[57] ABSTRACT

The bag sealing machine includes a horizontal working table having all of its working parts at the same level. Adjacent to the table are (1) a product in-feed conveyor driven by a novel support and drive arrangement, (2) a product pusher having a novel, pivotable pusher means, (3) a supply of folded film and an adjustable plow for forming the film into bags, of different selectable sizes, having two open sides, (4) a scissors-type L-sealer operated by a novel drive arrangement, and (5) a package out-feed conveyor driven by a novel support and drive arrangement like that of the in-feed conveyor.

28 Claims, 21 Drawing Figures

FIG. 3.
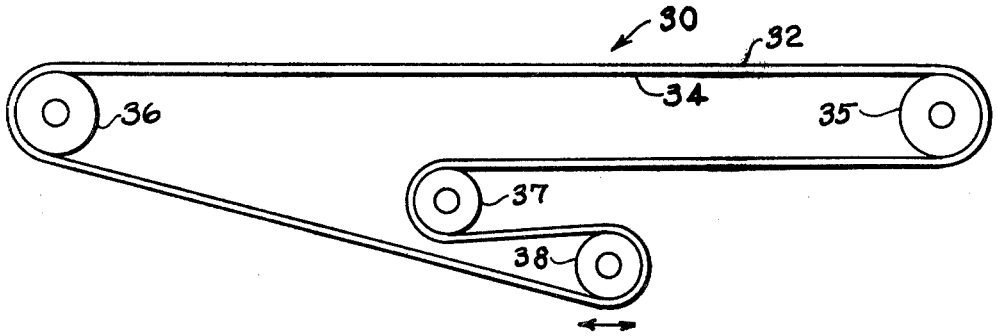
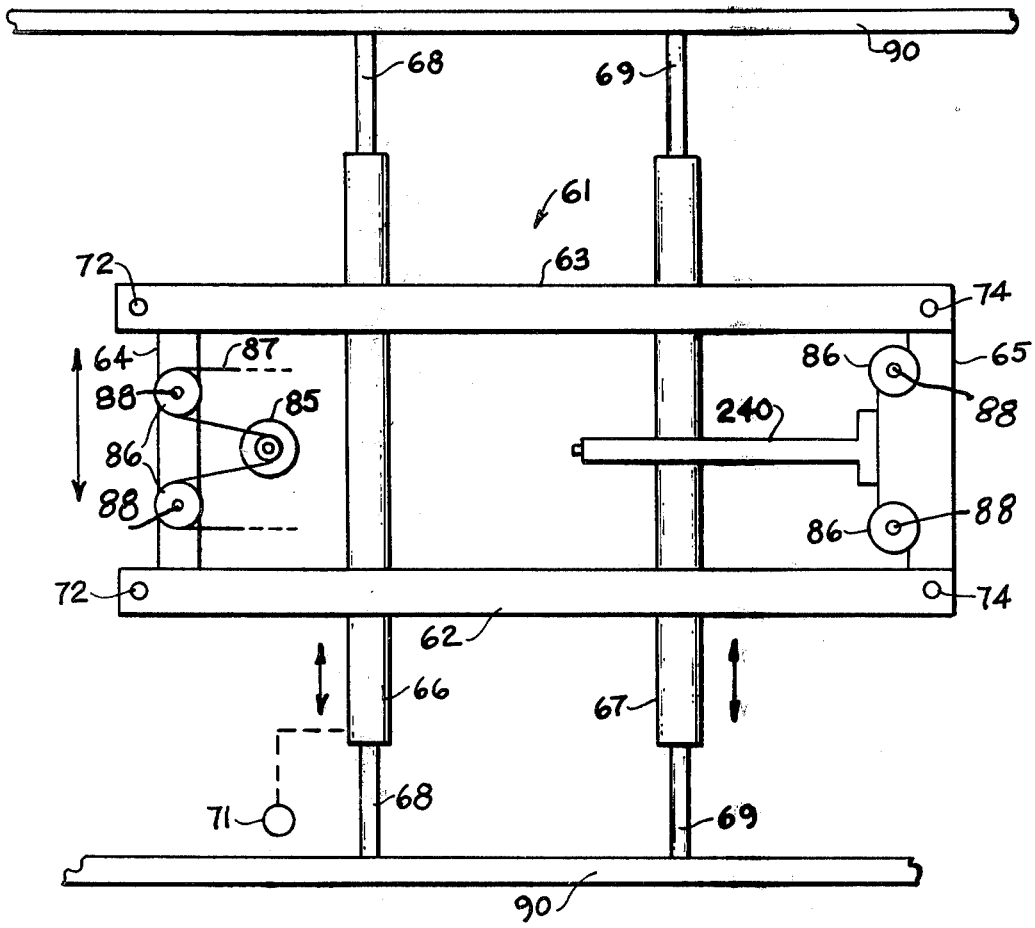
FIG. 6.

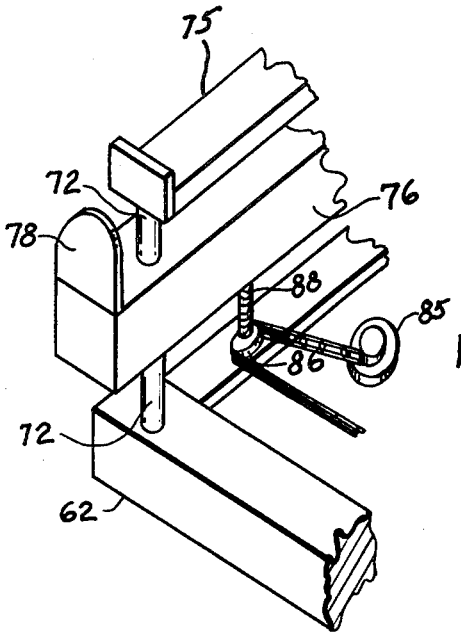
FIG. 8
FIG. 9
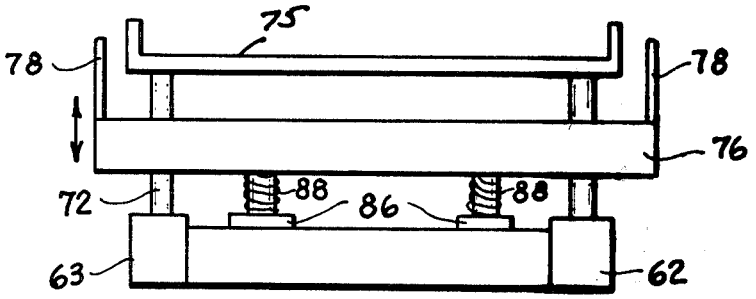

BAG SEALING MACHINE

CROSS-REFERENCE TO RELATED APPLICATIONS

This application is a continuation-in-part of application Ser. No. 735,036, filed Oct. 22, 1976, now abandoned.

BACKGROUND OF THE INVENTION

There are several types of automatic L-type packaging machines currently being marketed. In the most common types, the product fed into the machine, either at 90° or in line, drops down in front of a pusher and is then indexed into the film and into the seal zone. However, since there are certain unstable products which cannot tolerate being dropped, a machine has recently been introduced which eliminates the requirement for a drop by utilizing a two-stage pusher. In this machine, the product is initially advanced into position by a conveyor, a short stroke pusher arm is advanced into position behind the product, and then the pusher and product are indexed into the film and seal zone. During the return stroke of the pusher, the arm is retracted so as not to interfere with the next waiting product. While this device is suitable for certain products, it has inherent limitations. Since the nature of this mechanism is such that the pusher arm must be completely advanced and retracted once each cycle, it is obvious that, in order to achieve any reasonable level of speed, the pusher arm must be restricted to a relatively short length, which means that the product is essentially being pushed from one corner only. For many products, this is an unstable condition which results in twisting of the product and faulty packaging or interruption of the operation of the apparatus.

In the prior art, L-sealers have had the sealing frames, or at least the upper frame, hinged at the side of the path of travel of a package, so that the frame rotates about an axis which is parallel to this path of travel. This requires the sealing frame to pivot through an undesirably large angle and limits the speed of operation of the sealer.

In addition, in the prior art, bag-forming plows are fixed dimensionally so that, if it is desired to form bags of different sizes, plows of different sizes must be mounted on the machine. This is obviously time consuming and expensive and permits only limited variations in the sizes of bags which can be formed.

The apparatus of the invention overcomes the above-noted problems in the prior art and provides an efficient machine for handling a product, forming a bag for the product, and forming an L-seal to close the bag.

DESCRIPTION OF THE DRAWINGS

FIG. 3 is a side elevational view of the out-feed conveyor and its support and drive means;

FIG. 6 is a plan view of a support frame for the out-feed conveyor and the bag-sealing apparatus;

FIG. 8 is a perspective view of a portion of the apparatus of FIG. 7;

FIG. 9 is a rear view of the apparatus of FIG. 8;

DESCRIPTION OF THE PREFERRED EMBODIMENTS

The principles of the invention are described and illustrated for an L-type sealing machine. However, these principles and some of the apparatus described can be used with other types of sealing machines.

Figure 1:
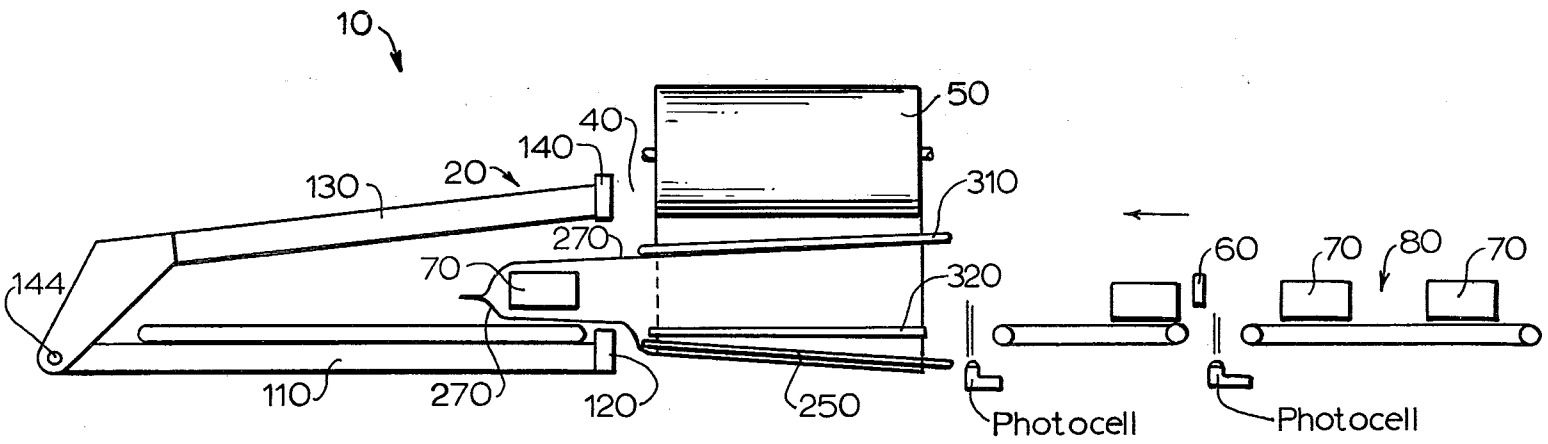
FIG. 1 is a side elevational view of the general overall structure of a bag-forming and sealing maching embodying the invention.

In general terms, referring to FIG. 1, sealing apparatus 10 embodying the invention includes, in order from left to right, a bag seal area 20 and outfeed conveyor 30, a bag-forming and loading area 40, a supply 50 of bag-forming film, a pusher assembly 60 for pushing product 70 into a bag at the bag-loading area 40, and a product in-feed area 80. The apparatus 10 includes a suitable floor-mounted support frame 90 (FIG. 2) for supporting the various components of the apparatus.

One characteristic of the machine 10 is that all of the operating surfaces, to be described, which support the product as it approaches a bag and the seal area 20, lie in the same plane so that a product, as it moves along from the in-feed area to the seal area, travels along the same plane. The sealing means and outfeed conveyor are laterally adjustable to accommodate products of different sizes, and the sealing means is vertically adjustable so that the portion of the seal about the product can be adjusted as desired.

Figure 2:
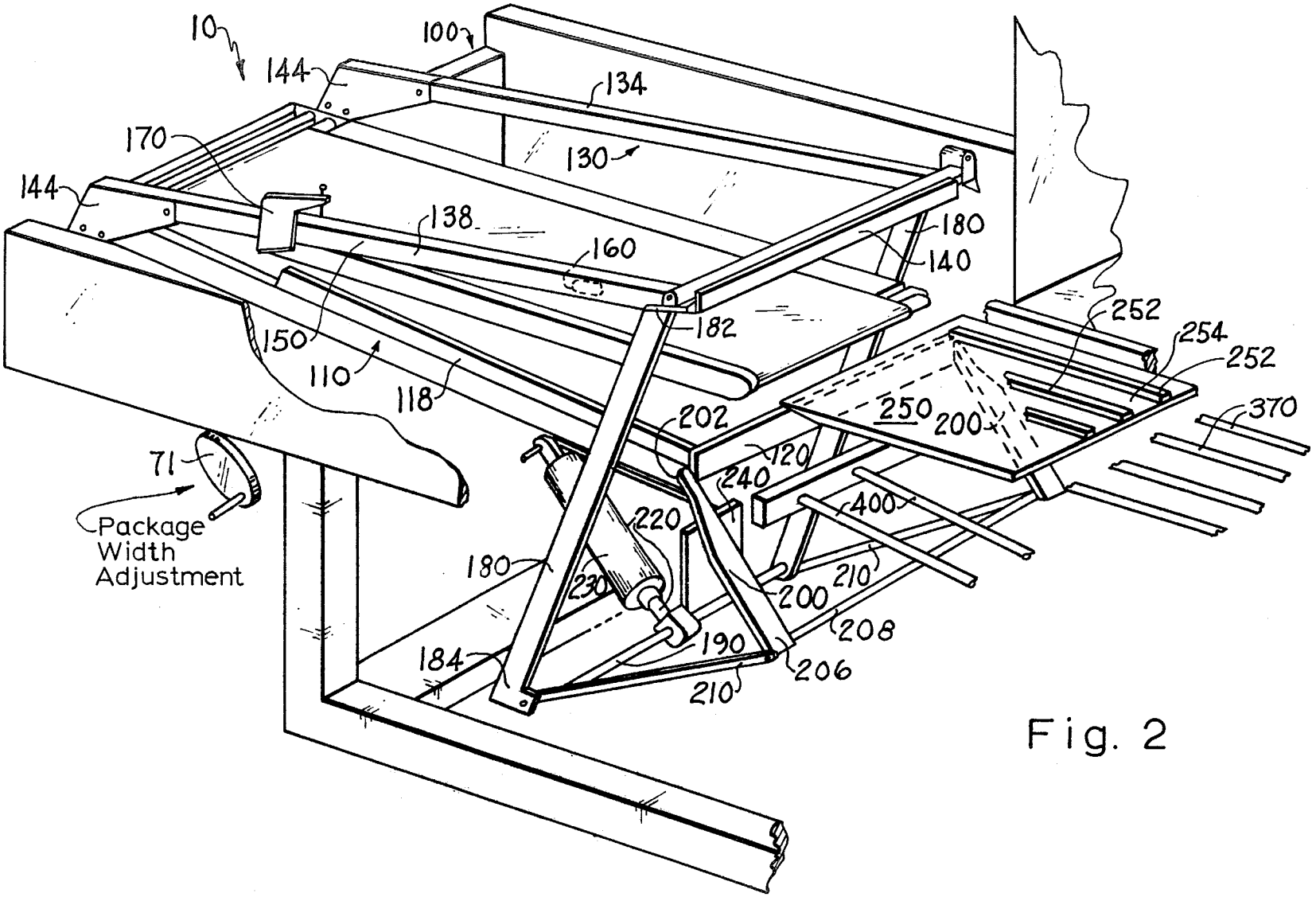
FIG. 2 is a perspective view of a portion of the machine of the invention including the bag-sealing apparatus and out-feed conveyor.

Considering some of the features of the invention in greater detail and referring to FIGS. 2 and 3 and the bag-sealing area 40, the conveyor 30 comprises a moving belt which is supported on a plurality of rollers and is adapted to move to the left to feed out a sealed package. The conveyor 30 has a longitudinal axis which defines a path of travel for sealed packages.

The conveyor belt 30 is made with an outer frictional surface 32, to which a sealed package can adhere and an inner surface 34 which is normally less frictional to save money in the manufacture thereof. The drive arrangement (FIG. 3) includes inner and outer end rollers 35 and 36 which are fixed in position, a drive roller 37 disposed between the end rollers and slightly below the horizontal axis between the end rollers, and a take-up roller 38 disposed between the drive roller 37 and the inner end roller 35. According to the invention, the conveyor belt 30 is wound so that all of the rollers 35, 36, and 38 engage the inner slippery surface of the conveyor belt except the drive roller 37 which engages the outer frictional surface, thus achieving optimum drive. In addition, having the end rollers 35 and 36 fixed and having the take-up roller 38 positioned between them provides optimum use of machine space. The take-up roller 38 is tapered to provide optimum control of the belt by the rollers, as is well known in the art.

The sealing apparatus 100 includes a pivotable rectangular lower frame 110 comprising side bars 114 and 118 and a front bar 120; and a pivotable rectangular upper frame 130 made up of side bars 134 and 138 and a front bar 140. The upper frame 130 carries a heatable sealing wire 42 in the side bar 138 and front bar 140 for forming an L-seal, as is well known in the art. The upper and lower frames are pivotably mounted at their rear or left hand ends 144, about pivot points or shafts 146 and 148 (FIG. 1), so that they can be brought into engagement with each other to perform a sealing operation on film disposed between them, and then they can be moved apart by being pivoted about their pivot point.

A safety mechanism associated with the sealing apparatus 100 (FIGS. 2 and 4) comprises an elongated U-shaped plate 150 loosely secured to the side face of side bar 138 of upper frame 130. The plate 150 is slidably or loosely mounted in association with switch means 160 so that, if a human arm or the like or other body lies between the sealing frames 110 and 130, the plate 150 is urged to operate switch means 160 and turn off the power and open the sealing frames.

Figure 4:
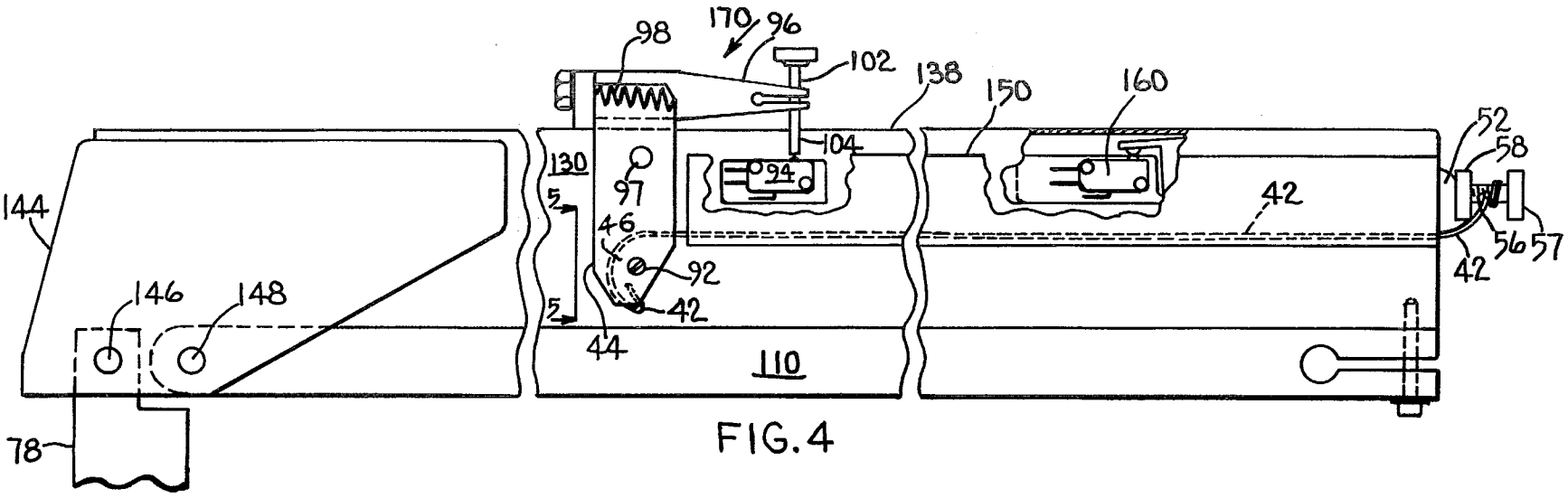
FIG. 4 is a side elevational view of the heater-wire support means.
Figure 15:
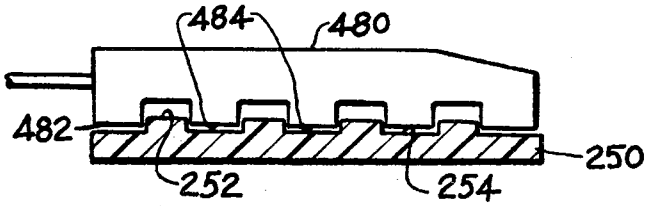
FIG. 15 is an elevational view, partly in section, of a portion of the product pusher mechanism.
Figure 5:
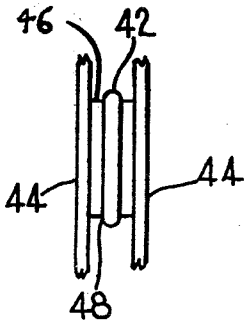
FIG. 5 is a view along the lines 5—5 in FIG. 4.

The heating wire 42 is in two pieces, with one extending along the front bar 140 and the other extending along the side bar 138, and both portions are secured at their ends without screws so that they can be readily removed or set in place without tools. The wire 42 in side arm 138 is shown in FIGS. 4 and 5. The wire-securing means includes a pair of spaced-apart plates 44 which carry between them a semi-circular metal block 46 having a groove 48 in its outer surface. The plates carry a screw 92, to which the power source for heating the wires is connected. One end 43 or wire 42 is inserted in a hole in the bottom of the block 46 and threaded upwardly along the groove 48 in which it becomes wedged (FIG. 5). The wire extends along the side bar 138, at the end of which is provided a wire-locking and tightening arrangement which includes a notched semi-circular metal block 52, like block 46, in which the wire 42 becomes wedged, and a threaded screw 54 having a hole 56 in which the other end of the wire is inserted. The screw 54 is turned by knob 57 to take up the slack and tighten the wire to the desired tension, at which time a locking nut 58 is screwed to hold the wire in front bar 140.

The plates 44 are secured to means 170 to sense wire expansion when the wire is heated during a sealing operation and to cut off the heating current at a desired moment when the wire has expanded a desired amount. This means includes a switch 94 mounted in bar 138 and generally horizontal arm 96 which is secured to the plates 44 which themselves are pivotably mounted on bar 138 about pin 97. The plates 42 and block 46 are spring-biased to the left as seen in FIG. 4 by spring 98. The arm 96 carries an adjustable post 102, the end 104 of which can be adjustably positioned adjacent to the switch 94.

Initially, wire 42 is set to the desired tension, and the post 102 is adjusted so that, when the heating current is passed through the wire, the wire lengthens, plates 44 pivot to the right, and, at the set expension of the wire, the arm 102 closes the switch 44 and turns off the heating current. The wire then cools and contracts, and the apparatus 59 is set for the next heating cycle.

Means are provided for adjusting the sealing frames laterally to accommodate packages of different sizes and for adjusting the sealing frames vertically to position the actual seal at the desired level on the package. This means includes a seal head frame 61 which comprises two longitudinal side metal bars 62 and 63, two transverse end metal bars 64 and 65, and two intermediate transverse bars 66 and 67 welded together into a rigid unit. Shafts 68 and 69 extend through the transverse bars 66 and 67 and are secured to the sides of the main machine frame 90. The seal head frame slides laterally on these shafts. Any suitable gearing arrangement, operated by knob 71, can be used to drive the seal head frame 61 laterally on the shafts 66 and 68.

Means for driving the sealing frames 110 and 130 vertically to adjust the seal head includes two spaced-apart vertical rear shafts 72 secured to the rear of the frame 61 and two spaced-apart vertical front shafts 74 secured to the front of the frame.

Figure 7:
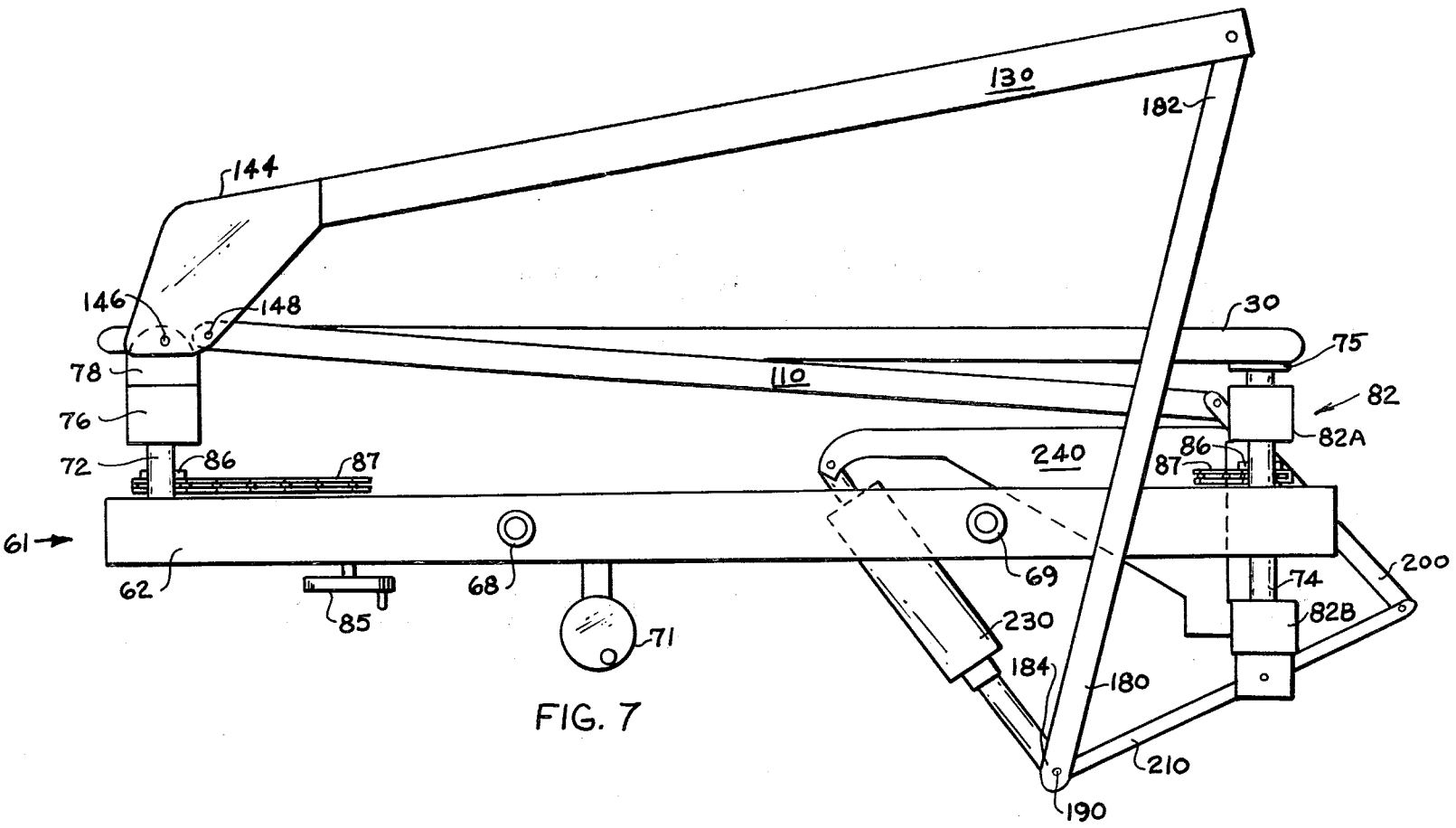
FIG. 7 is a side elevational view of the apparatus of FIG. 5 and the sealing apparatus supported thereby.
Figure 10:
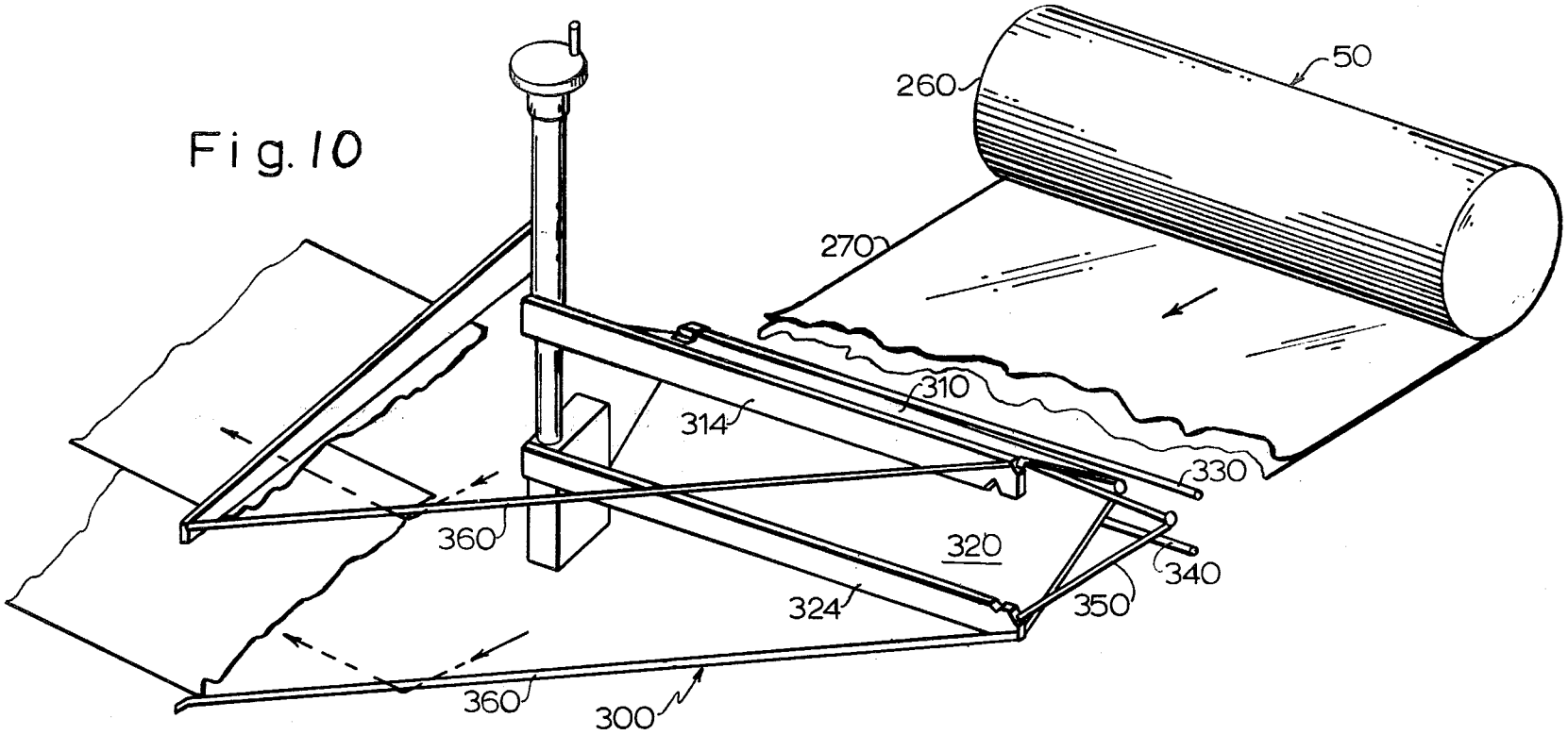
FIG. 10 is a perspective view of a bag-forming plow of the invention and the film supply therefor.
Figure 11:
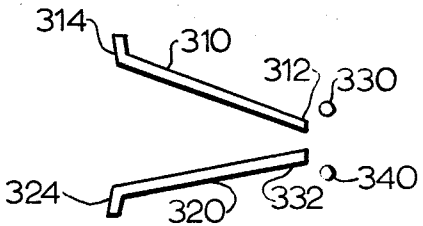
FIG. 11 is a side view of a portion of the apparatus of FIG. 10.

The end rollers of conveyor belt 30 are suitably supported, by means of front and rear horizontal bars 75 (only the rear bar is shown in FIG. 7), on the pairs of vertical posts 72 and 74. A horizontal transverse rear bar 76 is slidably mounted on the pair of rear posts 72, and the bar 76 carries end brackets 78 (FIGS. 6 and 7), to which the rear ends 144 of the side bars 134 and 138 of the upper sealing frame 130 is pivotally secured by pin or shaft 146 which comprises the pivot point for the upper sealing frame 130. The rear ends of the side bars 114 and 118 of the lower sealing frame are pivotally secured to the rear ends 144 of the side bars of the upper sealing frame by pins or shafts 148. A front bar 82, which is also generally C-shaped, is slidably mounted on front posts 74, and includes portions 82A and 82B which lie above and below the seal head frame 61.

A sprocket 86 and chain 87 drive arrangement (not shown in detail), operated by knob 85 is coupled to the front and rear bars, 76 and 82, whereby these bars can be raised and lowered as a unit and the sealing frames 110 and 130 can be raised and lowered vertically as a unit.

One suitable arrangement for operating the sealing frames 110 and 130, to open and close and to perform a sealing operation, (FIGS. 2 and 6), includes two generally vertical, relatively long, connecting rods 180 pivotally connected at one end 182 of each to the ends of the front bar 140 of upper frame 130, and the opposite end 184 of each rod 180 is pivotally mounted on a horizontal shaft 190. A similar shorter pair of connecting rods 200 are pivotally connected at one end of each to the ends of front bar 120 of lower frame 110. The other ends 206 of rods 200 are connected together by rod 208 for strength, and they are pivotally connected to connecting bars 210 which are pivotally connected between the ends 184 of rods 180 and ends 206 of rods 200. The shaft 190 is pivotally secured to the operating piston 220 of an air cylinder 230 which is suitably secured to a bracket 240. Bracket 240 is secured to the C-shaped bar 82 of the vertical rise frame so that the apparatus described in this paragraph moves vertically with the upper and lower sealing frames.

When the air cylinder 230 is operated, its piston 220 moves downwardly, as does the shaft 190. This pulls vertical bars 180 downwardly and pushes bars 200 upwardly to bring the upper and lower sealing frame into contact with each other.

As described, the operation of the sealing frames 110 and 130 is in the nature of a scissors and toggle action wherein the closing force increases as the frames come together. This permits the use of a smaller bore air cylinder 230 than might otherwise be required. In addition, the speed of movement of the sealing frames decreases as the frames close together. It is a relatively easy matter to adjust the parts so that the sealing frames just touch when they are fully closed.

To the right of the outfeed conveyor, as seen in FIGS. 1 and 2, and located at the bag-forming and loading area 40 is a stationary horizontal plate 250 of a material having a very low coefficient of friction and carrying spaced-apart parallel strips 252 of similar material which provide channels or slots 254 between them, for a purpose to be described. The plate 250 supports product to be packaged.

To the side and rearwardly of the plate 250, are mounted a supply 260 of folded film 270 and plow means 300 for turning the film 90° and forming it into a bag which is closed on two sides. This apparatus also includes pivoted bar 280 and other control mechanisms which assist in feeding the film to the bag-forming plow 300. The plow 300 comprises two rectangular plates 310 and 320 disposed at an angle to each other, with their rear edges 312 and 322 disposed parallel to and facing the roll of film and spaced apart slightly and extending across the plate 250 and across the operating path of the machine. The front edges 314 and 324, respectively, of the plates are more widely spaced from each other than the rear edges. This orientation of the plates is generally fixed; however, the plates are suitably mounted so that the spacing between them can be adjusted and varied to form bags of different sizes.

This is accomplished by rotating knob 325 which is threadedly coupled to the front edge 314 of upper plate 310 and thus raises bar 314 and increases the spacing between the front edges of the two plates. This increases the height of the bag formed by the plow and accommodates a larger product to be packaged.

The plow assembly also includes a pair of rods 330 and 340 spaced apart in vertical alignment at the rear of the plates 310 and 320 and disposed above and below the rear edges 312 and 322 of the plates. A triangular rod 350 is at the right side of the plow and extends from the front edges to the rear edges of the plates but spaced from the rear edges. Another rod 360 extends across the operating path of the machine from the upper plate 310 to near the seal area. As the folded film leaves the roll, one portion moves across the upper surface of the top plate 310 and rod 360, and the lower one extends under the plate 250 and exits between this plate and the outfeed conveyor 30 over the front bar 120 of the lower sealing frame.

To the right of the fixed plate 250 along the plane of operation of the machine 10 is a package conveyor which, in one arrangement, comprises a series of parallel rope-like belts 370, and, to the right of this, is the package in-feed conveyor belt 380. This belt 380 is driven by the same roller arrangement as the out-feed conveyor belt 30.

A product pusher is provided adjacent to the product conveyor. The pusher includes a horizontal base support plate 390 which lies adjacent to, and to the front of, the product conveyor and is oriented parallel to the machine frame. The base plate 390 is slidably mounted on rods 400. A pusher carrier 410 comprising a pair of spaced-apart plates 420 is pivotally secured, about shaft 422, at its rear end 424 to the horizontal base plate 390. An air cylinder 430 or the like is connected to the pusher carrier 410 for pivoting it with respect to the base 390.

Between the plates 420 are mounted front and rear sprockets 440 and 450, respectively, on shafts 441 and 422 and coupled together by a belt 460, with the rear sprocket 450 coupled to a drive means to be described. The shaft 441 of the front sprocket 440 is secured to an elongated, plate-like pusher 480 which lies across the table. The sprocket shafts are secured to bearings or inserts which are rotatably mounted in the plates 420 so that, when the plates 420 pivot with respect to the base 390, the sprocket inserts and the sprockets and the pusher maintain their orientation. Thus, the pusher, if horizontal, remains horizontal and, if vertical, remains vertical. The lower surface 482 of the pusher plate 480, which faces down during a pushing operation, is provided with fingers 484 which enter the slots 580 in plate 250. This provides the optimum presentation of the surface of the pusher plate with respect to the product to be pushed and permits the pusher plate to push, for example, a stack of individual sheets of paper, a product which is normally difficult to push to a packaging station.

The plates 420 carry an adjustable stop mechanism 426 which comprises a vertical shaft 428 having an operating knob 432 at its upper end and a stop plate 434 at its lower end which is adapted to engage a portion 436 of the rear end of base plate 390. The shaft 428 is vertically adjustable to permit the plates 420 to pivot upwardly about pivot point 422 through a desired angle, at the limit of which the stop plate 434 engages plate 390 and stops the upward pivoting of the assembly 410 of plates 420.

In addition, the plate 390 carries a pair of stops 438A and 438B for a purpose to be described.

The mechanism for driving the plate assembly 410 includes a first link 442 pivotally secured at one end 444 by a post 446 to the plates 420 and pivotally secured at the other end 448 by post 449 to one end 452 of a second link 454. The other end 456 of the second link 454 is pivotally coupled by post 455 to a plate 458 which is secured to the shaft 422 which drives the sprockets 440 and 450. The plate 458 is positioned to engage stop 438A when the pusher plate 480 is vertically oriented and when the plate assembly 410 is in its lowered position. The plate 458 is positioned to engage stop 438B when the plate assembly 410 is raised and pusher plate 480 is in the horizontal orientation. The arc through which plate 458 can rotate is 90°, which is required to rotate the pusher plate 480 between horizontal and vertical orientation.

The piston 462 of the air cylinder 430 is pivotally coupled by post 464 to about the center of the first link 442.

In operation of this apparatus, with the plate assembly 410 in the lowered position and with the pusher plate 480 vertical and at the end of its pushing path of travel due to the forward movement of plate 390 on shafts 400, the air cylinder 430 is operated to drive its piston 462 upwardly. The piston pushes the first link 442 and the plate assembly 410 upwardly until the stop plate 434 engages plate 390 and stops the upward movement of the plate assembly. At the same time, the first link 442 causes the second link 454 to rotate the plate 458 counterclockwise, as seen in FIG. 13, and this causes the sprockets 440 and 450 to rotate and drive the belt 460, and this continues until the plate 458 strikes the upper stop 438B, at which time the pusher plate 480 is horizontal, as desired.

The plate 390 and all of its associated apparatus is now driven rearwardly on shafts 400, and, at the end of its path of travel, the piston 462 of the air cylinder 430 is ready to receive a signal to retract and rotate the pusher plate 480 to the vertical position and lower it behind a product to be pushed in the next cycle. When the pusher plate is rotated, plate 458 strikes stop 438A, with the pusher plate in pushing position behind a product.

Figure 13:
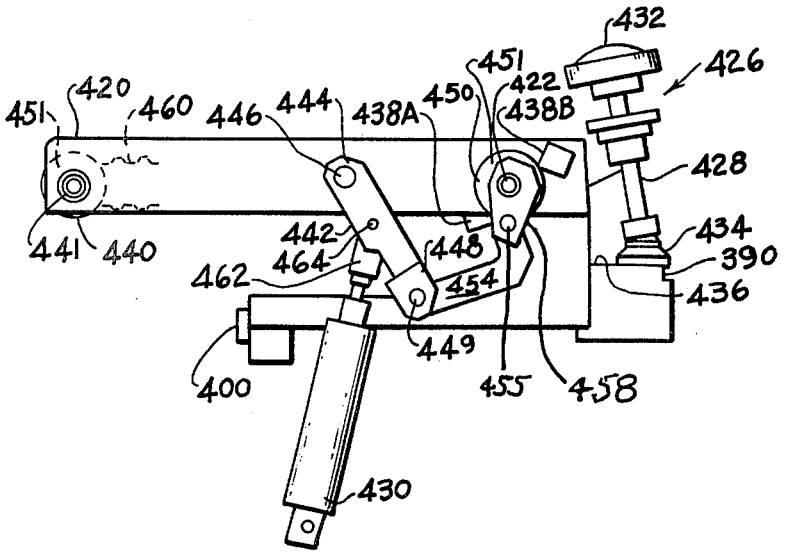
FIG. 13 is a side elevational view of the product pusher mechanism of the invention.
Figure 14:
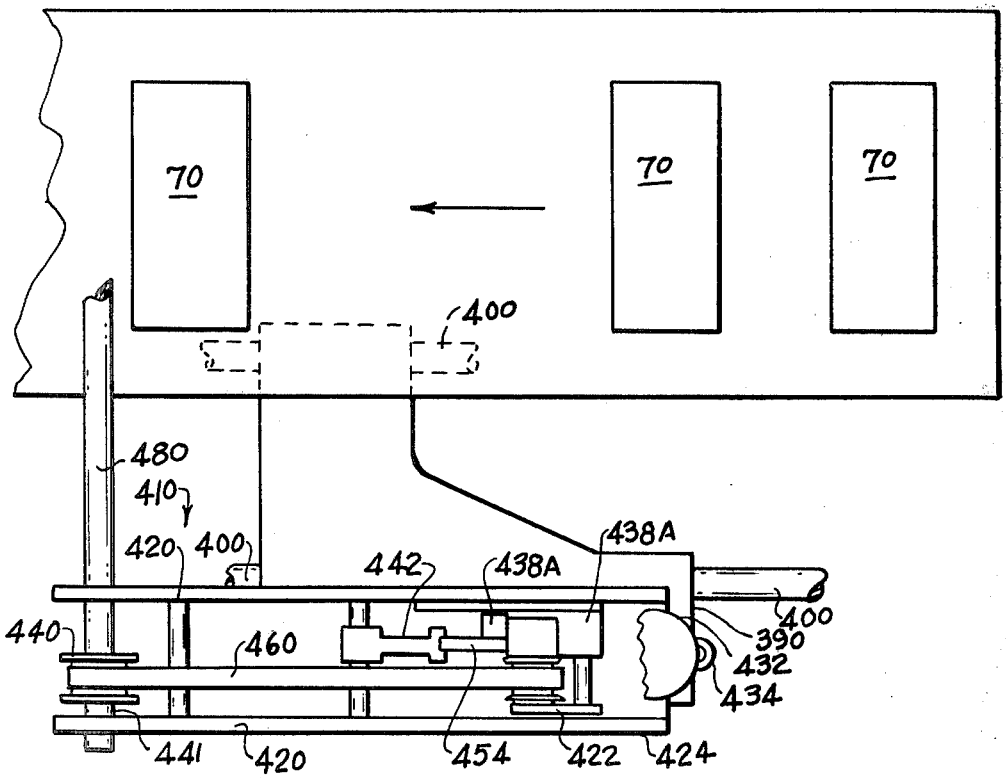
FIG. 14 is a plan view of the apparatus of FIG. 13 and a product in-feed conveyor.

It is noted that post 428 and its stop 454 in FIG. 13 would be raised the desired amount to provide a gap between stop 434 and plate 390.

Figure 12:
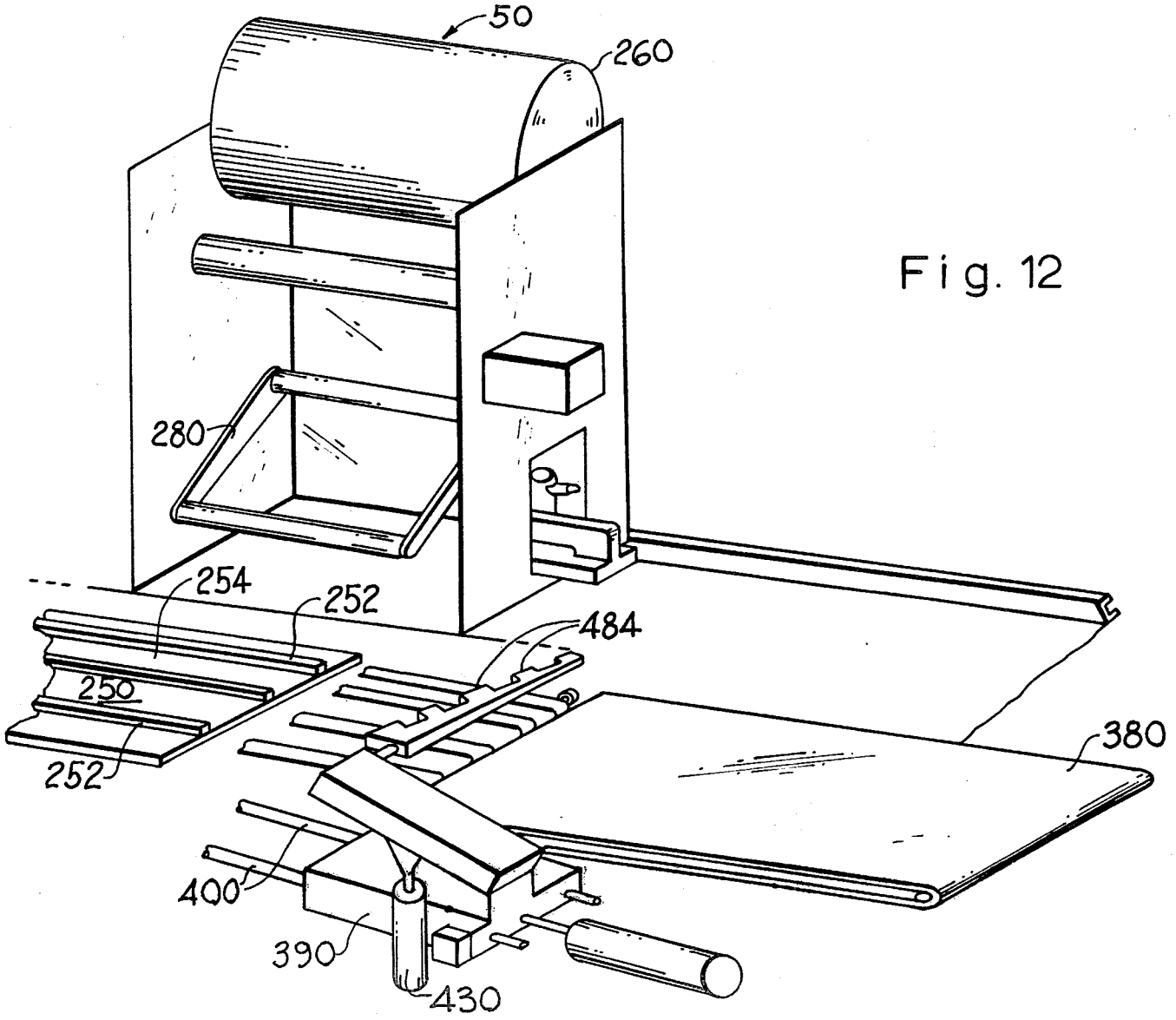
FIG. 12 is a perspective view of the film supply and bag-forming area and a product pusher mechanism.
Figure 12A:
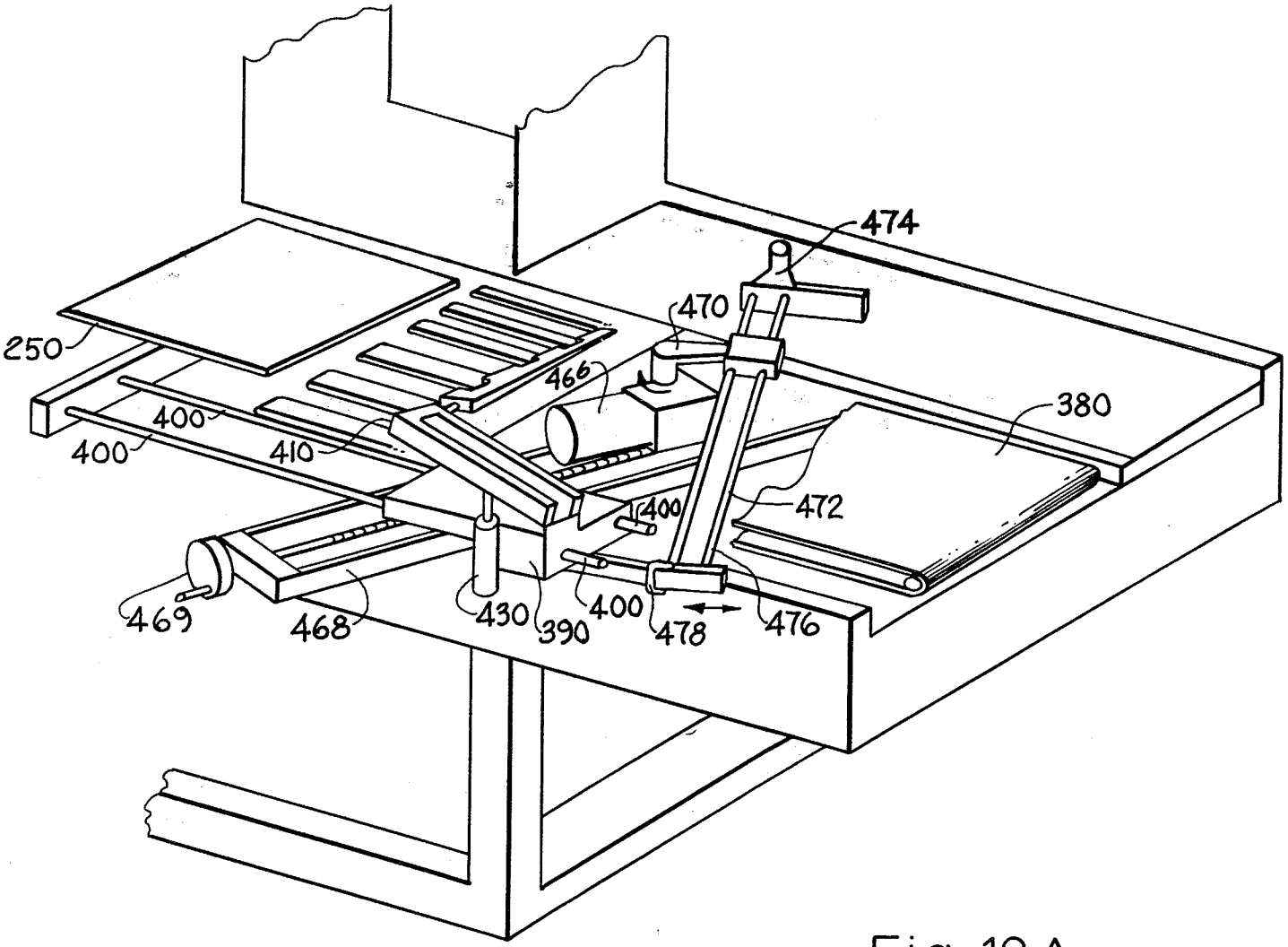
FIG. 12A is a perspective view of apparatus for driving the product pusher mechanism.

The preferred apparatus for driving the pusher assembly horizontally forward and backward, in performing a pushing operation, is a Whitworth quick-return mechanism. This apparatus, referring to FIG. 12A, includes a motor 466 adjustably mounted on a track 468 and having a crank 470 which is coupled by a slide to an arm 472. One end 474 of the arm is pivotably mounted on the machine frame, and the other end 476 is coupled by a linkage 478 to the plate 390 or some other portion of the pusher assembly.

In operation of this drive mechanism, as the crank 470 rotates, the arm moves forward to the left and backward to the right, and the forward motion of the arm 472 and the pusher assembly is first slow, then fast, and then slow. The return motion is fast. The length of the stroke of the arm 472 and the length of the path of travel of the pusher assembly is determined by the position of the motor 466 on its track 468.

Photocells are provided to control the feed of product to be packaged along the in-feed conveyor and onto the plate 250 in front of the film supply and to control the operation of the pusher plate 480.

In operation of the machine 10, assuming that the film has been fed to the space between the sealing frames and a cross seal has been formed, to provide a bag closed on two sides, with the pusher plate 480 horizontal and with the sprocket carrier plate 420 elevated so that the pusher plate 480 is elevated above the feed conveyor, the conveyor moves a product 70 so that it passes under and moves just ahead of the pusher. This is controlled by photocells.

Next, the pusher bar or plate 480 is twisted so that it is vertical to the conveyor table, and the carrier plates 420 are lowered to position the pusher 480 behind the product 70. Now, the pusher assembly is driven forwardly on rods 400, and the product 70 is pushed between the upper and lower sheets of film to the rear seal area. Next, the sealing frames are brought together to form the L-seal which closes the package. The outfeed conveyor now removes the package, and the sealing frames are opened.

As noted above, the plow plates 310 and 320 can be spaced apart different amounts to space the upper and lower films at different spacings to accommodate products 70 of different heights.

Figure 16:
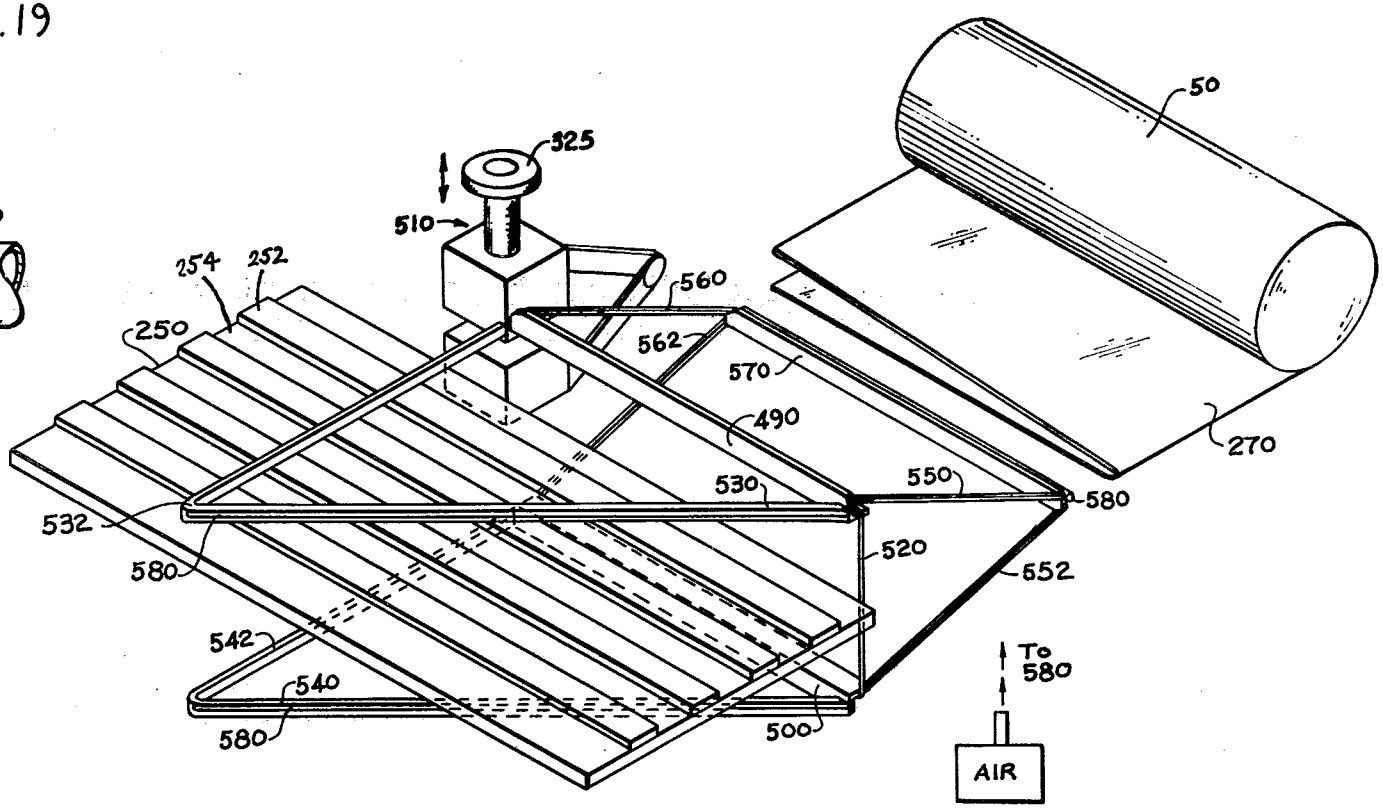
FIG. 16 is a perspective view of another bag-forming plow embodying the invention.
Figure 19:
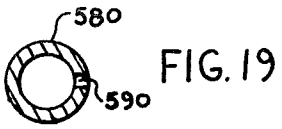
FIG. 19 is a sectional view of a portion of the plow of FIG. 16.
Figure 20:
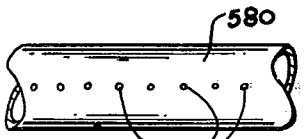
FIG. 20 is a front elevational view of the apparatus of FIG. 19.
Figure 17:
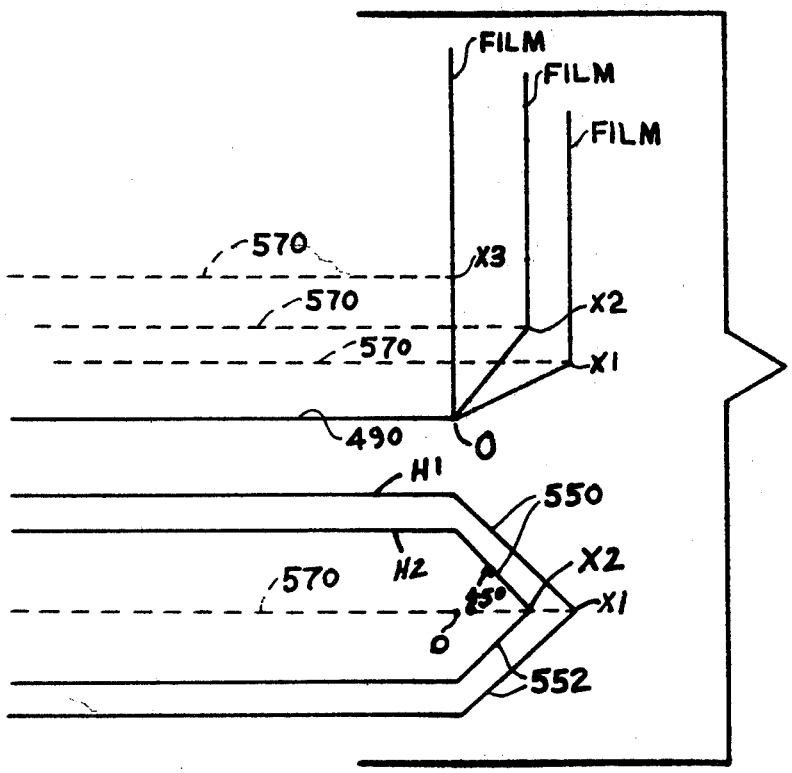
FIG. 17 illustrates schematically the relationship between the parts of the plow of FIG. 16 and the film.
Figure 18:
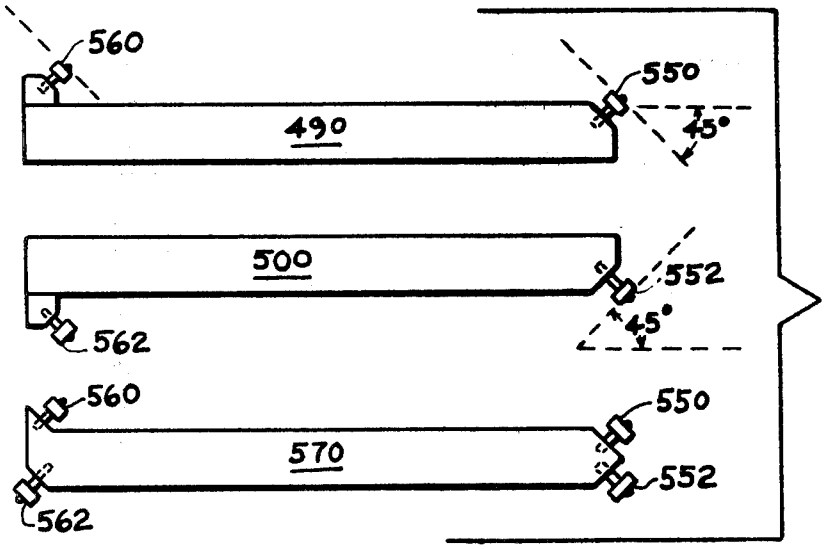
FIG. 18 is a front view of portions of the plow of FIG. 16.

A modification of the plow of the invention, shown in FIGS. 16 to 18, includes an upper triangular member which is disposed above table 250 and a lower triangular member which is disposed beneath the table 250. The upper triangular member includes a side bar 490, disposed above and parallel to the rear side edge of table 250 facing the film supply, a transverse bar 532 which extends across the table and a connecting bar 530. The lower triangular member includes a similar side bar 500, a transverse bar 542, and a connecting bar 540.

The lower triangular member is fixed in place, and the upper triangular member is adapted to be raised and lowered. To achieve this function, in one arrangement, the adjacent ends of bar 490 and bar 532 are secured to a housing 510 which has a screw thread drive means (not shown in detail) operated by knob 325 to provide the desired raising and lowering.

A flexible cord 520, of nylon or the like, is coupled between the right ends of the bars 490 and 500 to maintain the shape of the film as it turns 90° at the bars 490 and 500. In one arrangement, the cord 520 comes from a reel (not shown) which may be mounted in the housing 510 for the drive means. In any case, the cord lengthens and shortens as the plow is opened and closed.

According to the invention, film support means is connected to the two triangular members, and this means is disposed between these members and the film supply roll. This film support means includes a rear bar 570 disposed parallel to bars 490 and 500 and having its ends pivotally connected to the ends of bar 490 by side bars 550 and 560. The ends of bar 570 are also pivotally connected to the ends of bar 500 by side bars 552 and 562.

The coupling of the two pairs of right and left side bars to the horizontal bars is such that, as the upper triangular member and the bar 490 are raised and lowered, the rear bar 570 moves laterally to the right or to the left, to the left when the plow is closed and to the right when the plow is opened. The side bars rotate to accommodate this movement of the rear bar. With the front bar 490 in its lowermost position and with the plow closed, the bar 570 is at its maximum excursion to the left, and vice versa. Similarly, side bars 550 and 552 (also 560 and 562) are closest together when the bar 490 is down, and they move apart as the upper triangular member is raised.

This is the desired and required movement of the parts of the plow to accommodate to the orientation of the film 270 as the upper triangular member is raised to form a larger or deeper bag. As shown in FIG. 17, point X1 represents the position of the right end of bar 570 when the plow is open to form a bag of maximum size or depth. The right edge of the film is aligned with this point X1. As the plow is closed to a second position, the end of the bar 570 is at position X2, and the film has moved to align itself with this position of bar 570. The point X3 represents a third position, at which the plow is theoretically fully closed.

With the plow shown, any desired adjustment or opening and closing of the plow between a set maximum and minimum may be obtained.

The lower portion of FIG. 17 shows the projection of right side bars 550 and 552 onto a vertical plane through the bars 490 and 500 for each position or opening of the plow illustrated in the upper portion of FIG. 17. It can be seen that, at each position, the side bars form a 45° right triangle, because length 0−X1=0−H1, or 0−X2=0−H2. Of course, the other side bars project the same triangles. This dictates the optimum relationship of the side bars to the bars 490, 500 and 570. Thus, upper side bars 550 and 560 are connected so that they rotate in planes which are disposed at 45° to the horizontal plane. The lower bars 552 and 562 are similarly connected. However, the upper side bars 550 and 560 are connected so that their plane of rotation has a negative slope with respect to the horizontal and the plane of rotation of the side bars 552 and 562 has a positive slope with respect to the horizontal.

This is illustrated in FIG. 18 which shows bar 490 and upper side bars 550 and 560 connected to the ends thereof so that they are oriented in and rotate in planes, represented by dash lines which are at 45° to the horizontal, with a negative slope. Similarly, on lower bar 500, the side bars 552 and 562 are connected to the ends thereof so that they are oriented in and rotate in planes, represented by the dash lines, which are at 45° to the horizontal, with a positive slope.

The opposite ends of the upper and lower side bars are connected to the bar 570 at the same orientation as their first-described ends are connected to bars 490 and 500.

This arrangement allows the plow to automatically assume the proper configuration for each plow opening to match the film flow.

As the folded film, with the fold to the right, proceeds from its supply roll, it is opened by bar 570, and it is turned 90° at cord 520, and it proceeds along bars 530 and 540 to the sealing area. To facilitate this flow of the film, means are included to provide bars 570, 530, and 540 with an air bearing for the film, and this means comprises tubular members 580 secured to the surfaces of these bars which the film contacts. These tubular members 580 have a plurality of apertures 590 along their lengths, and they are connected in series to a source of air whereby air may be blown through the apertures to provide the desired air bearing effect and essentially frictionless movement of the film over the bars 570, 530, and 540.

The apparatus of the invention has many advantages, one of which arises from the fact that the sealing frames oscillate about an axis transverse to the longitudinal axis of the machine, rather than about an axis which is parallel to the machine axis, as in the prior art. This permits the sealing frame to oscillate through a smaller angle, for the same size package, than L-sealers of the prior art, with the result that the machine of the invention can be operated at higher speed.

Another advantage of the invention arises from the fact that the bag-forming plow is adjustable so that bags of any desired size can be formed readily and easily with a single plow structure.

Another important advantage of the invention resides in the novel pusher assembly which permits high speed operation and efficient pushing of a wide range of products including stacks of paper.

What is claimed is:

1. An L-sealer comprising a horizontal surface for supporting a product wrapped in a plastic bag to be sealed on two sides to form a closed package, said surface defining a path of travel for products and packages, a first rectangular frame carrying an L-shaped sealing bar and positioned above said path of travel and said surface, a second rectangular frame having an L-shaped supporting surface positioned beneath said surface and cooperating with said L-shaped sealing bar during a sealing operation, said first and second rectangular frames both being pivotably mounted about an axis disposed transverse to said path so that they can be raised and lowered with respect to said surface during the performance of a sealing operation, with said first frame moving up and down above said path and said surface, and said second frame moving up and down below said path and said surface, said first frame including front and rear members, which are parallel to each other and transverse to said path of travel, and left and right side members which are parallel to each other and to said path of travel, said second frame including front and rear members which are parallel to each other and transverse to said path of travel, and left and right side members which are parallel to each other and to said path of travel, a first horizontal support shaft, disposed transverse to said path of travel, an air cylinder having its movable piston secured to said support shaft, said frames being pivotably mounted generally about their rear members so that, when said frames are pivoted, said front members move toward and away from each other, a first rigid bar secured between the ends of said shaft and the ends of the front member of said first frame, and a linkage, including two bars, secured between the ends of said shaft and the front member of said second frame whereby movement of said piston of said air cylinder in one direction causing said frames to close on each other, and movement of said piston in the opposite direction causing said frames to move apart.

2. The apparatus defined in claim 1 wherein said first and second frames are coupled together to form an operating unit.

3. The apparatus defined in claim 2 and including means for moving the sealing assembly comprising said first and second frames horizontally and laterally with respect to said surface to position the sealing assembly at different locations to adjust to products of different sizes.

4. The apparatus defined in claim 2 and including means for moving said unit vertically to position said L-sealer at different vertical locations with respect to the product to be sealed to form the seal at different elevations on the product.

5. The apparatus defined in claim 1 and including a plow for forming a film bag open on two sides, said plow being adjustable to form bags of different volumes.

6. Bag sealing apparatus comprising an upper rectangular sealing frame including front and side bars and a lower rectangular sealing frame including front and side bars, an L-shaped sealing bar coupled to the front bar and one side bar of said upper sealing frame, said sealing bar carrying a sealing wire, a first generally semicircular block secured to said sealing bar near one end thereof, said first block having a notched outer surface, one end of said wire being secured to said first block and threaded along said notched outer surface in which it becomes wedged, said wire extending along said bar from said block to another portion thereof, a second generally semicircular block having a notched outer surface and located at said other portion of said bar, said wire being threaded along the outer surface of said second block and wedged in the notched outer surface thereof, a rotatable shaft secured to said bar and having a hole in which the other end of said wire can be inserted, said shaft being rotatable to take up said wire to place it under tension, and a locking nut on said shaft for locking it in a selected position with said wire under a selected tension.

7. The apparatus defined in claim 6 and including switch means associated with said first block and settable to close upon a predetermined stretching of said wire due to the flow of heating current therethrough, closure of said switch means serving to turn off said heating current.

8. The apparatus defined in claim 7 and including an insulating plate secured to said first semicircular block and extending above said sealing bar so that it is accessible to an operator, said switch being mounted on said sealing bar, said plate carrying an adjustable arm positioned to engage and close said switch at any selected positioning of said arm.

9. Product handling and packaging apparatus including first means for forming a bag of packaging material for receiving a product to be packaged therein, second means forming a path for moving a product to the bag formed by said first means, and a product pusher assembly mounted adjacent to said path and including an arm disposed parallel to said path and a pusher blade rotatably secured to said arm and disposed across said path, said pusher blade being rotatable into horizontal and vertical orientation with respect to said path and said arm being pivotable so that it and said blade can be raised and lowered with respect to said path, said arm and blade being horizontally reciprocable along said path, between a forward position and a rear position, said assembly including means for driving said pusher assembly through a cycle including:

1. at said forward position, pivoting said arm and said pusher blade, in its vertical orientation, upwardly above said path and rotating said blade to its horizontal orientation,
2. driving said assembly horizontally and thus retracting said blade to said rear position,
3. pivoting said arm and said pusher blade, in its horizontal orientation, downwardly and rotating said blade into its vertical orientation, said blade being positioned behind a product to be pushed thereby, and
4. driving said arm and said blade, in its vertical orientation, horizontally forward to said forward position and simultaneously pushing said product in the same direction.

10. The apparatus defined in claim 9 wherein said assembly includes a carrier for said product pusher, said carrier being pivotally mounted near one end thereof remote from said first means and carrying said arm and blade and adapted to raise said arm and blade above said path, an adjustable stop mechanism secured to one end of said carrier and positioned to engage a portion of said pusher assembly to limit the rotation of said carrier, a pair of sprockets including a front and rear sprocket, and a belt driven by said sprockets, all mounted on said carrier and adapted to pivot with said carrier whereby said front sprocket can be raised to an elevated position above said path, said pusher blade being coupled to said front sprocket by said arm which can be rotated by said sprocket, first and second links pivotally coupled together at one end of each, said first link having its other end coupled to said carrier to perform the raising and lowering thereof, the other link having its other end coupled to the rear sprocket and carrying a stop plate, and a piston coupled to said first link whereby forward movement of said piston drives said first link whereby forward movement of said piston drives said first link to raise said carrier and said pusher blade until said stop mechanism engages said portion of said pusher assembly and discontinues the elevation of said carrier, and thereafter, further movement of said piston causes said second link to rotate said sprockets and said stop plate between first and second stop blocks on said carrier, to rotate said pusher blade through a desired angular rotation determined by the positioning of said first and second stop blocks.

11. The apparatus defined in claim 10 wherein said angular rotation is 90°.

12. The apparatus defined in claim 9 wherein said pusher blade has a lower surface which is provided with projecting ribs separated by slots, said path including a table having on its surface, elevated strips separated by slots, the projecting ribs of said pusher blade being positioned to enter the slots in said table during a pushing operation.

13. Bag forming apparatus comprising a supply roll of folded film disposed adjacent to and at one side of a horizontal surface, said surface including a table onto which film from said roll is fed and at which a bag is formed by said plow, said plow including a first upper triangular frame disposed above said table and including a first bar disposed parallel and adjacent to said roll of folded film at the side of said table, a second lower triangular frame disposed beneath said table and including a second bar disposed parallel to and beneath said first bar of said first triangular member, a flexible cord coupled between said upper and lower triangular frames, a first upper rectangular frame formed of said first bar, a rear bar and two upper side bars, said side bars being pivotally coupled to said first bar and said rear bar, a second rectangular frame formed of said second bar, said rear bar and two lower side bars pivotally secured to said second bar and said rear bar, said rectangular frames extending toward said roll of film, and means secured to said upper triangular frame for raising it and lowering it with respect to said table, said cord lengthening and contracting as said upper triangular frame is raised and lowered, the pivotable coupling of said side bars causing said rectangular frames to shift to the right or left as said upper triangular frame is raised and lowered to accommodate to said film as it leaves the supply roll and the bag being formed is enlarged or made smaller.

14. The apparatus defined in claim 13 wherein said upper and lower side bars rotate in planes disposed at about 45° to the horizontal.

15. The apparatus defined in claim 13 wherein said upper and lower side bars rotate in planes disposed at about 45° to the horizontal, the planes of said upper side bars having a negative slope and the planes of said lower side bars having a positive slope.

16. Bag sealing apparatus comprising an upper first sealing frame and a lower second sealing frame, said frames being pivotally mounted about parallel axes said first frame including a front member and left and right side members, said second frame including a front member and left and right side members, a first horizontal support shaft, an air cylinder having its movable piston secured to said support shaft, said frames being pivotably mounted so that, when said frames are pivoted, said front members move toward and away from each other, a first rigid bar secured between the ends of said shaft and the ends of the front member of said first frame, and a linkage, including two bars, secured between the ends of said shaft and the front member of said second frame whereby movement of said piston of said air cylinder in one direction causes said frames to close on each other, and movement of said piston in the opposite direction causes said frames to move apart.

17. The apparatus defined in claim 16 and including a scissors drive mechanism which includes a first shaft, a first pair of arms pivotally secured to said shaft and to said upper sealing frame, a second pair of arms pivotally secured to said lower sealing frame and to a pair of links which themselves are pivotally secured to said first shaft, and piston means secured to said first shaft for driving said first shaft in a first direction which causes said sealing frames to come together and in a second direction which causes said sealing frames to move apart.

18. The apparatus defined in claim 16 and including a package conveyor, a rectangular frame which supports said conveyor and said sealing frames, and a pair of horizontal shafts on which said rectangular frame is mounted for lateral movement.

19. The apparatus defined in claim 16 and including a support frame, said sealing frames being mounted on said support frame, and means for moving said support frame vertically up and down so that said sealing frames can be moved vertically up and down as a unit to adjust their spacing with respect to the product being packaged.

20. The apparatus defined in claim 18 wherein said conveyor includes a belt which has a relatively frictional outer surface and a smoother less frictional inner surface, and drive means of said conveyor belt, said drive means comprising end rollers which engage the inner surface of said conveyor belt, a drive roller disposed between said end rollers and engaging the frictional outer surface of said conveyor belt, and a take-up roller disposed adjacent to said drive roller and engaging the less frictional inner surface of said conveyor belt.

21. Package-sealing apparatus comprising a table, bag-sealing means at one end of said table, bag-forming means at about the center of said table, and product-presenting means at the other end of said table, said product-presenting means including a pusher for pushing a product to be bagged toward said bag-formed means, said pusher including a pushing arm which includes mechanical means whereby it can be oriented vertically when it is used as a pusher and oriented horizontally and elevated above the table when it has completed a pushing operation and is retracted to its pushing position, and mechanical means for reciprocating said pushing arm back and forth along said table.

22. Package-sealing apparatus comprising a table, bag-sealing means at one end of said table, bag-forming means at about the center of said table, and product-presenting means at the other end of said table, said product-presenting means including a pusher for pushing a product to be bagged toward said bag-forming means, said pusher including a pushing arm which includes mechanical means whereby it can be oriented vertically when it is used as a pusher and oriented horizontally when it has completed a pushing operation and is retracted to its pushing position, and mechanical means for reciprocating said pushing arm back and forth along said table, said mechanical drive means includes a member mounted for rotation in a horizontal plane parallel to said table, said member carrying a shaft slidably and adjustably mounted thereon, one end of said shaft being coupled to said pushing arm to cause it to reciprocate back and forth as said member rotates.

23. Product handling apparatus including means for forming a bag for receiving a product to be packaged therein, means forming a path for moving a product to the bag formed by said means, and a product pusher assembly including a pusher bar having its axis disposed across said path and disposed in a plane parallel to said path, means for raising and lowering said pusher bar with respect to said path and for rotating said pusher bar about its axis into a vertical position in which it can push a product and into a horizontal position in which it does not push a product, said assembly also including means for (a) moving said pusher bar, in its vertical position and in its lowered position, forwardly against a product to push the product along said path and into a film bag, and for (b) moving said pusher bar, in its horizontal position and elevated above said path and above a product thereon, rearwardly to a position where it can then be lowered behind a product which it can push when in its vertical position.

24. Apparatus for handling a product to be packaged comprising a generally horizontal operating table including a product in-feed area, a film-supply area, bag-forming means, and an outfeed conveyor, and a product pusher assembly including a pusher bar having its axis disposed across said path and disposed in a plane parallel to said path, means for raising and lowering said pusher bar with respect to said path and for rotating said pusher bar about its axis into a vertical position in which it can push a product and into a horizontal position in which it does not push a product, said assembly also including means for (a) moving said pusher bar, in its vertical position and in its lowered position, forwardly against a product to push the product along said path and into a film bag; and for (b) moving said pusher bar, in its horizontal position and elevated above said path and above a product thereon, rearwardly to a position where it can then be lowered behind a product which it can push when in its vertical position.

25. Bag sealing apparatus comprising a table, an upper sealing frame and a lower sealing frame, said frames being pivotally mounted adjacent to said table about parallel axes which are transverse to the path of travel of a product along said table, film-sealing means carried by said frames, a supply roll of folded film disposed adjacent to and at one side of said path, the film extending from said roll toward said path of travel and generally transverse thereto, and a plow including a first upper triangular frame disposed above said table and including a first bar disposed parallel and adjacent to said roll of folded film at the side of said table, a second lower triangular frame disposed beneath said table and including a second bar disposed parallel to and beneath said first bar of said first triangular member, a flexible cord coupled between said upper and lower triangular frames, a first upper rectangular frame formed of said first bar, a rear bar and two upper side bars, said side bars being pivotally coupled to said first bar and said rear bar, a second lower rectangular frame formed of said second bar, said rear bar and two lower side bars pivotally secured to said second bar and said rear bar, said rectangular frames extending toward said roll of film, means secured to said upper triangular frame for raising it and lowering it with respect to said table, said cord lengthening and contracting as said upper triangular frame is raised and lowered, the pivotable coupling of said side bars causing said rectangular frames to shift to the right or left as said upper triangular frame is raised and lowered to accommodate to said film as it leaves the supply roll and the bag being formed is enlarged or made smaller.

26. In apparatus for forming a bag in which a product can be inserted and sealed, the apparatus including a support table on which the packaging operations are performed and a supply roll of folded film, the improvement residing in a plow for forming the film into a bag, the plow comprising a first upper triangular frame disposed above said table and including a first bar disposed parallel and adjacent to said roll of folded film at the side of said table, a second lower triangular frame disposed beneath said table and including a second bar disposed parallel to and beneath said first bar of said first triangular member, a flexible cord coupled beneath said upper and lower triangular frames, a first upper rectangular frame formed of said first bar, a rear bar and two upper side bars, said side bars being pivotally coupled to said first bar and said rear bar, a second lower rectangular frame formed of said second bar, said rear bar and two lower side bars pivotally secured to said second bar and said rear bar, said rectangular frames extending toward said roll of film, and means secured to said upper triangular frame for raising it and lowering it with respect to said table, said cord lengthening and contracting as said upper triangular frame is raised and lowered, the pivotable coupling of said side bars causing said rectangular frames to shift to the right or left as said upper triangular frame is raised and lowered to accommodate to said film as it leaves the supply roll and the bag being formed is enlarged or made smaller.

27. The apparatus defined in claim 26 and including air flow means in said upper and lower triangular frames for cushioning the film as it moves along said frames.

28. Bag forming apparatus comprising a supply roll of folded film disposed adjacent to and at one side of a horizontal surface, said film including an upper web and a lower web, said surface including a table onto which film from said roll is fed along a first path and at which a bag is formed by a plow, said plow including a first upper frame disposed above said table for guiding one web of said film as it changes direction from said first path to a second path, said first upper frame including a first side bar, a second lower frame disposed beneath said table for guiding the other web of said film as it changes direction from said first path to a second path, said second lower frame including a second side bar, a flexible cord coupled between said first and second frames and positioned to guide said film, third and fourth frames extending toward said roll of film and coupled to a common side bar positioned adjacent to said roll of film, the third frame also being pivotally coupled to said first side bar and to said first upper frame, said fourth frame also being pivotally coupled to said second side bar and to said second lower frame, and means for changing the spacing between said first frame and said second frame whereby the common bar and said third and fourth frames shift to the right or left and assist in changing the size of bags formed from said film.

* * * * *